United States Patent [19]

Takahashi

[11] 4,031,269

[45] June 21, 1977

[54] ELECTROSTATIC IMAGE FORMING METHOD

[75] Inventor: Isoji Takahashi, Asaka, Japan

[73] Assignee: Fuji Photo Film Co., Ltd., Minami-ashigara, Japan

[22] Filed: June 25, 1974

[21] Appl. No.: 482,869

[30] Foreign Application Priority Data

June 25, 1973 Japan ..... 48-72021

[52] U.S. Cl. ..... 427/24; 427/27

[51] Int. Cl.[2] ..... G03G 13/00

[58] Field of Search ..... 117/17.5; 96/1 R, 1 SD, 96/1.4; 118/637; 355/3 R, 3 DD; 427/14, 19, 24, 27

[56] References Cited

UNITED STATES PATENTS

| | | | |
|---|---|---|---|
| 2,637,651 | 5/1953 | Copley | 96/1.4 |
| 2,681,473 | 6/1954 | Carlson | 117/17.5 |
| 2,972,304 | 2/1961 | Jarvis | 96/1.4 |
| 3,033,765 | 5/1962 | King et al. | 117/17.5 |
| 3,038,799 | 6/1962 | Metcalfe et al. | 117/17.5 |
| 3,132,963 | 5/1964 | Jarvis | 427/19 |
| 3,326,709 | 6/1967 | Nail | 427/19 |
| 3,518,969 | 7/1970 | Snelling | 117/17.5 |
| 3,576,624 | 4/1971 | Matkan | 96/1.4 |
| 3,719,481 | 3/1973 | Makino et al. | 96/1.4 |
| 3,821,011 | 6/1974 | Hashiue et al. | 117/17.5 |

*Primary Examiner*—Bernard D. Pianalto
*Attorney, Agent, or Firm*—Gerald J. Ferguson, Jr.; Joseph J. Baker

[57] ABSTRACT

An electrostatic image forming method, which uniformly charging the surface of an electrostatic image forming material comprising (1) surface portions each having an insulating surface and occupying the surface of an insulating support in a patternlike manner and (2) conductive layer portions each having a conductive surface and formed on the remaining areas of the surface of the insulating support in a manner that the conductive layer portions are electrically isolated from the earth: grounding the surfaces of the charged conductive layer portions to the earth so as to remove the charges from the charged conductive layer portions so that the charges in the surfaces of the insulating surface portions remain as the desired electrostatic image.

10 Claims, 12 Drawing Figures

FIG. 1a
PRIOR ART
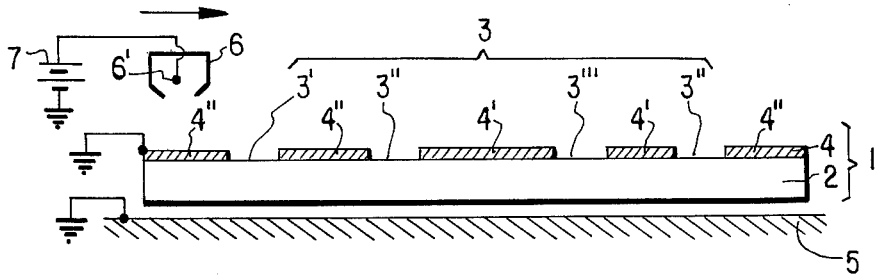
FIG. 1b PRIOR ART
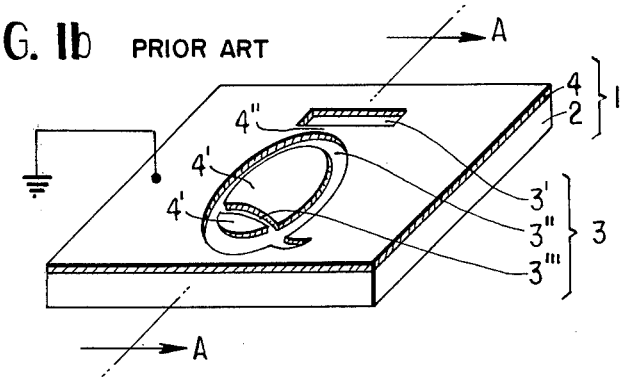
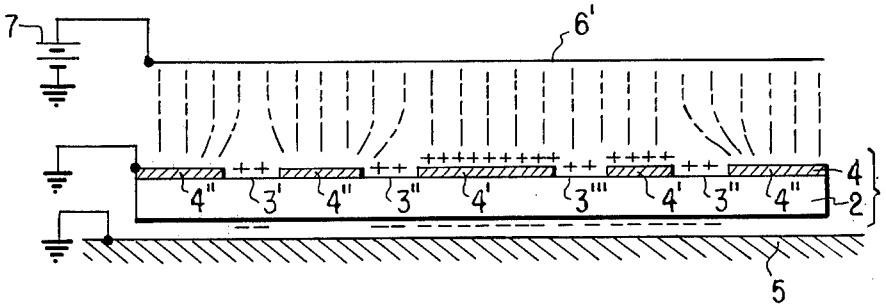
FIG. 2
PRIOR ART FIG. 3
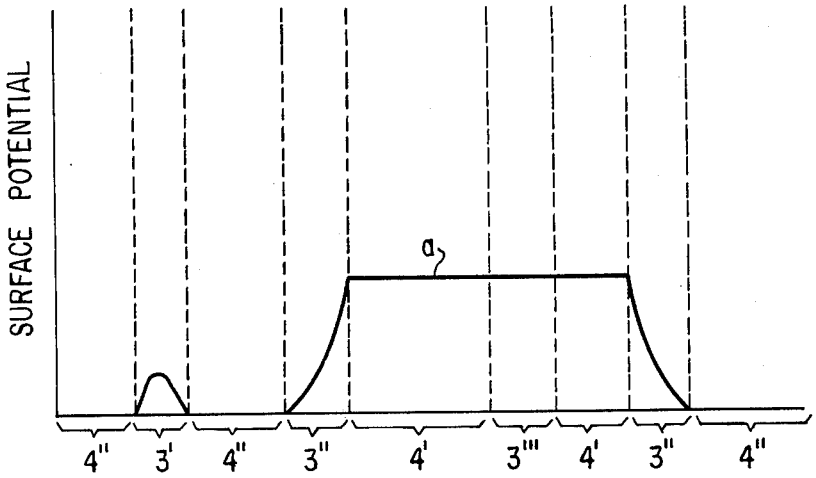
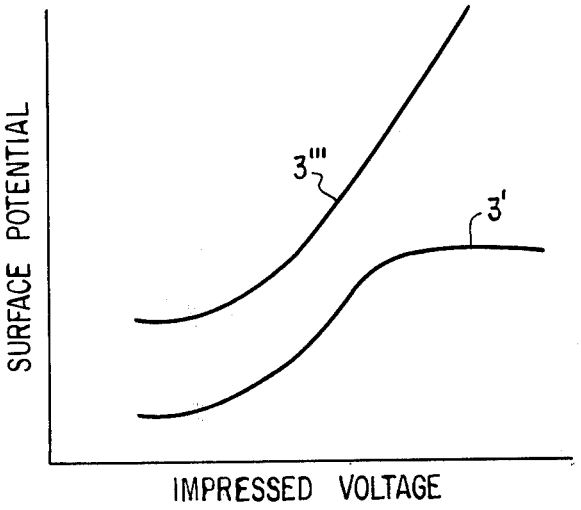
FIG. 4

ELECTROSTATIC IMAGE FORMING METHOD

BACKGROUND OF THE INVENTION

1. Field of the Invention

The present invention relates to an electrostatic image forming method, and, more particularly, to a method of forming an electrostatic image on the insulating surface portions which are formed in a pattern-like manner on an electrostatic image forming material together with the conductive surface portions.

2. Description of the Prior Art

In the electrostatic printing field, charging the insulating surface portions of a material which has conductive surface portions in addition to the insulating surface portions on an electrostatic image forming material has been widely accomplished. In this conventional method, more specifically, the electrostatic image forming material, on which the conductive and insulating surface portions are distributed in a pattern-like manner, is placed on a conductive base plate. Then, charges are applied to the insulating portions, for example, using a corona charging process, with the conductive portions being grounded to the earth, thus froming the desired electrostatic image.

Where an electrostatic image forming material which has a conductive intermediate layer formed on an insulating support and insulating layer portions formed on the conductive intermediate layer in a pattern-like manner is used in the conventional method, it is easy to ground the conductive layer to the earth with satisfactory results.

On the other hand, another method has been proposed in which an image forming material which has conductive surface portions and insulating surface portions both distributed in a pattern-like manner is used, thus dispensing with the conductive intermediate layer on the insulating support.

In accordance with the above method, a method has been proposed in which a conductive layer capable of being peeled off is formed on the surface of an insulating support. Desired portions of the conductive layer are then removed in a pattern-like manner using a stencil pen or the like so as to form recessed and exposed insulating surface portions on the surface of the insulating support. Charges are applied to the recessed insulating surface portions using a corona charging process or the like to thereby form a desired electrostatic image thereon.

In this method, moreover, when the electrostatic image on the insulating surface portions is intended to be transferred by applying toners thereto, the toner image obtained is formed on the recessed surface portions, so that the toner image will scarcely be damaged even if registration in the transfer operation is carried out. Therefore, this method is quite important in obtaining satisfactory transfer quality.

However, the method, in which the corona charging process is applied to the electrostatic image forming material formed with the conductive and insulating surface portions without the formation of the conductive intermediate layer on the insulating surface, is inevitably accompanied by the following drawbacks.

Reference will now be made to FIGS. 1 to 4 of the accompanying drawings. In FIG. 1*a*, reference numeral 1 indicates an electrostatic image forming material (which will be referred to hereinafter, for brevity, as a "material"), which is composed of conductive surface portions 4 in which at least the surfaces are conductive and formed on an insulating support 2 and of insulating surface portions 3 formed in a pattern-like manner on the insulating support 2. The insulating surface portions 3 are formed in such a fashion that a conductive layer 4, which is formed on the surface of the insulating support 2 to constitute the conductive surface portions 4, is removed in a pattern-like manner mechanically or chemically so a to expose the desired surface portions to the outside.

For illustrative purposes only, the insulating surface portions 3 are shown in FIG. 1*b* to have a shape of a modified letter "$\overline{Q}$." In this case where the letter "$\overline{Q}$" is engraved, the insulating surface portions 3 are divided into the following portions:

a. The portion 3′ which is surrounded by conductive layer portion 4″ around the letter;

b. The portion 3″ which is surrounded both by the conductive layer portion 4″ and by island-shaped conductive layer portions 4′ electrically isolated from the portion 4″; and c. The portion 3‴ which is surrounded both by the portion 4″ and by the portions 4′.

The "material" 1 as above is placed on a conductive base plate 5, which is grounded to the earth as shown in FIG. 1*a*, with its back face down. A corona charging process is then carried out by moving above the material a corona charger 6, which is connected with a power source 7 and whose corona electrode 6′ is impressed with a DC high voltage in the direction of the arrow. If the conductive layer portion 4″ around the letter "$\overline{Q}$" is grounded to the earth in the manner as shown in FIGS. 1*a* and 1*b*, the charging operation is effected by the following actions.

At an initial stage of the charging operation, the corona ions are substantially uniformly applied to the surface of the material. When the charging operation proceeds, the electric field of the material will reach the condition as shown in FIG. 2. In FIG. 2, the broken line arrows will indicate the behavior of the corona ions irradiated from the electrode 6′ of the corona charger 6.

Among the ions thus uniformly applied, the ions applied to the surrounding conductive layer portion 4″ will be neutralized because the portion 4″ is grounded to the earth, whereas the ions applied to the insulating surface portions 3 and the island layer portions 4′ will be stored therein as shown by the plus signs. The ions thus stored will exhibit a blocking action to succeeding corona ions, which are approaching to be applied to the material as shown by the broken line arrows. These charges establishing the blocking or repulsing electric field will be referred to for brevity as "blocking charges". Especially, the ions, which are approaching the vicinity of the insulating surface portions 3′ and 3″ having both of its sides or one of its side grounded to the earth, will be subjected to the repulsive force of the ions having the blocking charges and accordingly will charge their courses such that they will be caught by the conductive layer portion 4″ and neutralized.

On the contrary, the ions, which are approaching both the conductive island layer portions 4′ electrically isolated from the surrounding layer portion 4″ and the insulating surface portion 3‴ surrounded by the portions 4′, will be further trapped therein because they are separated from the grounded conductive layer portion 4″ and accordingly because they cannot leak thereto. The trapping or storing action of the charges will continue until they build up sufficiently as blocking charges against the corona ions coming, or until an equibirium condition is attained with the potential of the electrode 6' of the corona charger 6. As a result, the charges stored in the conductive island layer portions 4' and in the insulating surface portion 3''' surrounded thereby will be increased to raise the potentials of the portions 4' and 3'''. On the other hand, as these potentials become higher and higher increasing their repulsive forces, it becomes more and more difficult for corona charges to approach the insulating suface portion 3'', which are defined both by the conductive island layer portions 4' and by the grounded conductive layer portion 4''.

The charges thus obtained are illustrated in FIG. 3 in terms of the distribution of the surface potentials.

In FIG. 3, the abscissa is taken from the A – A' cross-section of FIG. 1*b* and the ordinate indicates the surface potentials of the respective portions. As shown, the potential in the grounded conductive layer portion 4'' surrounding the letter"$\overline{Q}$"is zero, and the potentials in the conductive island layer portions 4' isolated from the layer portion 4'' have a certain level because the charges impinging upon the layer portions 4' are stored therein and cannot leak to the layer portion 4''.

That portion 3' of the insulating surface portions 3 forming the image, which is surrounded by the grounded conductive layer portion 4'', has a cetatin potential at its center, but this potential decreases in value toward the periphery until it becomes zero at its peripheral edges. This is because, during the charging operation, the ions leak to the conductive layer portion 4'' which is grounded to the earth. On the other hand, in the insulating surface portion 3'' which is defined by the conductive island layer portions 4' and by the grounded conductive layer portion 4'', the coming corona ions are repulsed by the blocking voltage of the conductive island portions 4', so that the surface portions 3'' have a potential of a certain level at the periphery of the island portions 4' but a potential which decreases toward the periphery of the grounded conductive layer portion 4'' until it becomes zero at the peripheral edge of the portion 4''. On the contrary, the insulating surface portion 3''', which is surrounded by the conductive island layer portions 4', has a uniform potential of a certain level.

As shown in FIG. 3, the level of the uniform potential of the insulating surface portion 3''' is much higher than the maximum level of the insulating surface portion 3', which is surrounded by the conductive layer portion 4''. This is confirmed by the experimental results, as shown in FIG. 4. FIG. 4 is a graphical presentation, in which the surface potentials both of the insulating surface portion 3' surrounded by the grounded conductive layer portion 4'' and of the insulating surface portion 3''' defined by the conductive island layer portions 4' are plotted against the impressed voltage. The potential of the insulating surface portion 3' is, as can be understood from this graph, saturated at a certain level. On the contrary, the potential of the insulating surface portion 3''' defined by the conductive island layer portions 4' is increased continuously with an increase in the impressed voltage of the corona charging operation.

As is apparent from the foregoing descriptions, the following disadvantages will arise, in the case where an electrostatic image is formed in the insulating surface portions of an electrostatic image forming material which has electrically isolated conductive layer portions on its surface.

First of all, the electrostatic image obtained has a limited low potential. This means that a visual image of high density cannot be obtained after the electrostatic image is developed;

Secondly, the distribution of the charges in the insulating surface portions forming the electrostatic image cannot be made uniform. This phenomenon arises because the potential at the peripheral edge of the insulating surface portion adjoining the conductive layer portion will have a low level. After having been subjected to a developing treatment, the electrostatic image thus obtained cannot produce a clear visual image of high contrast.

Thirdly, the potential of the insulating surface portion will have different levels depending upon whether the conductive layer portions surrounding the insulating surface portion are grounded or not. The electrostatic image thus obtained will produce a non-uniformity in the visual image.

The third disadvantage can be obviated by grounding all of the island portions to the earth, but this grounding operation becomes more difficult as the number of islands increases. As a matter of fact, however, it is almost impossible to ground all of the islands because an actual electrostatic image is composed of so many islands. Even if all of the islands could be grounded, moreover, the first and second disadvantages still remain.

SUMMARY OF THE INVENTION

In view of these conventional drawbacks, it is therefore an object of the present invention to provide an improved method for forming an electrostatic image, in which the foregoing disadvantages are completely obviated.

Another object of the present invention is to provide an improved electrostatic image forming method of the above type, in which the electrostatic image is formed on the insulating surface portions which in turn are formed in a desired pattern-like manner on an electrostatic image forming material together with the remaining conductive layer portions.

Accordingly the present invention provides an electrostatic image forming method comprising:

uniformly charging the surface of an electrostatic image forming material comprising a pattern-like distribution of surface portions having an insulating surface and formed on an insulating support and of layer portions having a conductive surface and formed on the surface of the insulating support, such that the conductive layer portions are electrically isolated from the earth; and grounding the surfaces of the charged conductive layer portions to the earth so as to removed the charges therefrom to thereby retain the charges in the surfaces of the insulating surface portions in the pattern-like manner. Thus, an electrostatic image having a uniform and high charge level is formed on the image forming portions of the insulating surface portions even for a material which has conductive layer portions isolated from the insulating surface portions.

BRIEF DESCRIPTION OF THE DRAWINGS

These and other objects and advantages of the present invention will be apparent from the following description taken in conjunction with the accompanying drawings.

FIGS. 1*a*, 1*b* and 2 are explanatory views showing the prior-art method for forming an electrostatic image.

FIG. 3 is a graphical presentation showing the potential distribution of the charges on the electrostatic image forming material.

FIG. 4 is also a graphical presentation showing the surface potential which is built up by the corona voltage impressed on the surface portions to form the desired electrostatic image.

DETAILED DESCRIPTION OF PREFERRED EMBODIMENTS

The present invention will now be described in detail with reference to FIGS. 5*a* to 7*b*.

Figure 5A:
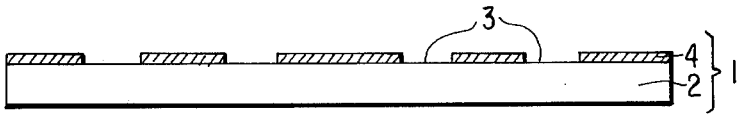
FIGS. 5*a* to 5*d* are a series of explanatory views showing the steps involved in the electrostatic image forming method according to the present invention.

In FIG. 5*a*, one example of the material used in the present invention is shown, which as the same construction as that of FIGS. 1*a* and 1*b*. That is, reference numeral 1 designates an electrostatic image forming material, which includes the insulating support 2, the image forming portions 3 having insulating surfaces thereon, and the conductive layer portions 4 acting as the non-image portions. As the insulating support 2, basically any insulating material such as paper, plastic materials, natural rubber, glass, ceramic materials, etc., can be employed. As the conductive layer portions, those materials having thereon metal layers such as layers of aluminum, copper, silver, gold, mixtures thereof and alloys thereof can be employed. Also, a paper which has been treated to render at least the surface conductive or an insulating binder material containing dispersed therein, at least in the surface portion, conductive particle, such as carbon black, graft carbon, etc., can also be employed.

By way of example only, the conductive layer portions 4 and the image forming portions 3 can be formed by mechanically or chemically removing a conductive layer in a pattern-like manner after the conductive layer has been applied to the insulating support 2. A suitable chemical method which can be employed involves in general, masking the conductive layer on the insulating support and contacting the uncovered areas with a solvent which dissolves the conductive layer. This leaves the conductive layer only at those parts where there was no cover of conductive layer, and the conductive layer is removed at the areas due to the mask with the insulating support being exposed. A suitable mechanical method involves simply the scratching away or abrading off of the conductive layer using mechanical methods such as remove with iron pen employing a metal pen or stylus to expose the insulating support. Alternatively, the areas of the conductive layers (such as a vacuum evaporated thin aluminum film) which are to be removed can be removed using a laser beam. As an alternative a conductive layer can be applied to the insulating support using an electroplating or vacuum-evaporation method to form the desired pattern-like conductive layer portions thereon. As an additional technique, the conductive areas desired can be formed by selectively adhering a conductive layer or surface to the insulating support. In one embodiment the surface portions having an insulating surface can exist as recesses in the conductive layer and in another embodiment the layer portions having a conductive surface can exist as projections or raised areas above the insulating surface. It should be understood here that these conductive layer portions 4 and the image forming portions 3 can be formed using any conventional method whereby pattern-like areas of conductive layer portions 4 and image forming portion 3 are formed.

As to the resistance levels, the conductive layer portions 4 can desirably have a surface resistance less than about $10^9\Omega/\square$, and the image forming portions 3 can desirably have a surface resistance larger than about $10^{12}\Omega/\square$. These resistance levels are critical in that the surface resistance of an excessively high level of the conductive layer portions 4 will make it quite difficult for the charges caught by the portions 4 to be neutralized even when the portions 4 are grounded. In another aspect, the surface resistance of an excessively low level of the image forming portions 3 erroneously will allow the charges in the portions 3 to leak to the conductive layer portions 4.

Figure 5B:
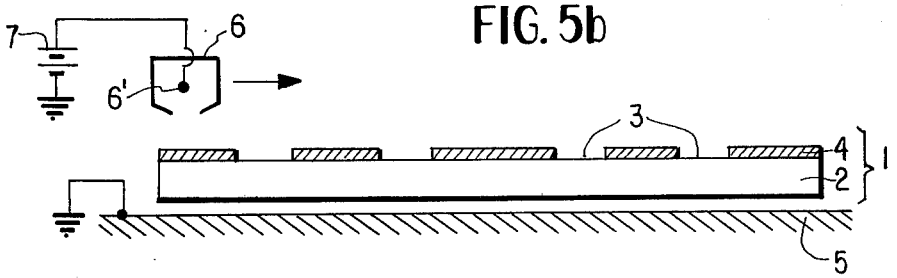

Then, the material 1 is placed on the grounded conductive base plate 5 with the back face of its support 2 down in the manner as shown in FIG. 5*b*. The corona charger 6, with the corona electrode 6′ of the corona charges connected to a DC high voltage power source 7, is moved above the material 1 in the direction of the arrow so as to apply the charges thereto. At this instance, the conductive layer portions 4 are suspended above the base plate 5 so as to be electrically isolated therefrom. The corona ions, which are irradiated from electrode 6′ of the corona charger 6, are then applied uniformly to the entire surfaces of the conductive layer portions 4 and the image forming portions 3, as shown in FIG. 5*c*.

The charges thus uniformly retained will then establish on the entire surface of the material 1 a similar high voltage to that in the areas both of the insulating image forming portion 3′′′ and of the conductive island layer portions 4′, as shown in FIG. 3.

In this instance, moreover, the conductive layer portions are electrically insulated from the earth, and the extent of this insulation described below has been found to be sufficient. More specifically, since it is considered sufficient that the conductive layer portions can maintain their high potential until the termination of the corona charging operation, the time constant CR will be sufficient for usual practical purposes if the time constant assumes value larger than about 2 to 3 seconds, in which the letter C denotes the electrostatic capacity of the conductive layer portions with respect to the earth whereas the letter R denotes the resistivity in between. The level of this time constant CR can preferably be larger than 10 seconds. For instance, when the insulating support has a thickness of 50 $\mu$ and a dielectric coefficient of about 2, then the conductive layer portions have a time constant of about 2 seconds and can be satisfactorily charged, if the resistance thereof is larger than about $5 \times 10^8\Omega/cm^2$. This is because the conductive layer portions have an electrostatic capacity of about $4 \times 10^{-9}$ farads/cm$^2$. In this connection, it will be understood that the insulation between the insulating support and the base plate has to be increased because the electrostatic capacity C in between decreases with the increase in the thickness of the support. Likewise, the resistance of the conductive layer portions can be decreased accordingly, if the area of the insulating support is increased with the resultant increase in the capacity C.

Figure 5C:
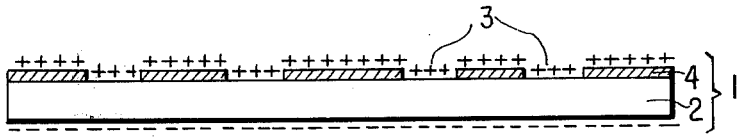

In FIG. 5*c*, the negative charges as shown on the back face of the insulating support 2 are built up such that charges having an opposite polarity to that of the positive charges, which have been induced in the conductive base plate, are discharged in the small clearance between the base plate of FIG. 5*b* and the back face of the support 2. These opposite charges are left in the back face of the support even after the material 1 has been separated from the conductive base plate 5.

The relationship between the impressed corona voltage of the corona ion charges, which are caught by the conductive layer portions 4 and the insulating surface portions 3 of the material and the surface potential is similar to that of the solid curve 3''' as shown in FIG. 4. As is apparent from the graph in FIG. 4, the conductive layer portions can be charged, according to the present invention, at a higher potential that the case of the solid curve 3', in which the conductive layer portions are grounded to the earth during the charging operation according to a conventional method. As a result of the present invention, moreover, the potential of the conductive layer portions will be substantially linearly increased for an impressed voltage where the solid curve 3' is in the area of saturation.

Thus, charges of sufficient amount can be stored in the insulating surface portions or the electrostatic image forming portions.

Figure 5D:
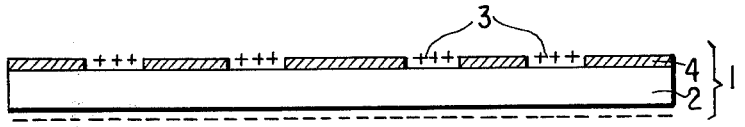

After this treatment, the conductive layer portions 4 are brought into contact with a conventional means such as a grounded element. Then, the charges in the conductive layer portions 4 leak to the earth, so that an electrostatic image of a uniform and high potential is formed on the image forming portions 3 having insulating surfaces, as shown in FIG. 5*d*.

Another embodiment of the present invention will now be described with reference to FIG. 6.

In this embodiment, the electrostatic image forming material 1, which is constructed in a similar manner to that of FIGS. 5*a* to 5*d*, is arranged with its conductive layer portions 4 being electrically isolated from the earth, and the corona charger 6, upon which a high positive voltage is impressed, is moved in the direction of the arrow above the conductive layer portions 4 on the material 1 so as to apply corona charges thereto. Simultaneously with this treatment, another corona charger 16, upon which a negative high voltage is impressed, is moved in the direction of the arrow below the back face of the material 1 or of the insulating support 2, so that the surface and back face of the material 1 can be subjected to a simultaneous charging operations of opposite polarities. In FIG. 6, reference numerals 6' and 16' indicAte corona wires, respectively, of the corona chargers 6 and 16. Likewise, reference numerals 7 and 17 indicate a DC high voltage power sources, which supply electric currents of high voltage to the corona chargers 7 and 17, respectively.

In this manner, the positive corona ions, which are irradiated from the electrode 6' of the corona charger 6, can be applied substantially uniformly to the insulting image forming portions 3 and the conductive layer portions 4 both on the material 1.

On the other hand, the negative corona ions, which are emitted from the electrode 16' of the corona charger 16, are also applied substantially uniformly to the back face of the support 2. After this treatment, when the conductive layer portions 4 are grounded to the earth by being brought into contact with suitable conventional means such as a grounded metal, an electrostatic image having a uniform and high potential can be formed, in a similar manner to that of FIG. 5, on the insulating image forming portions 3.

Figure 7A:
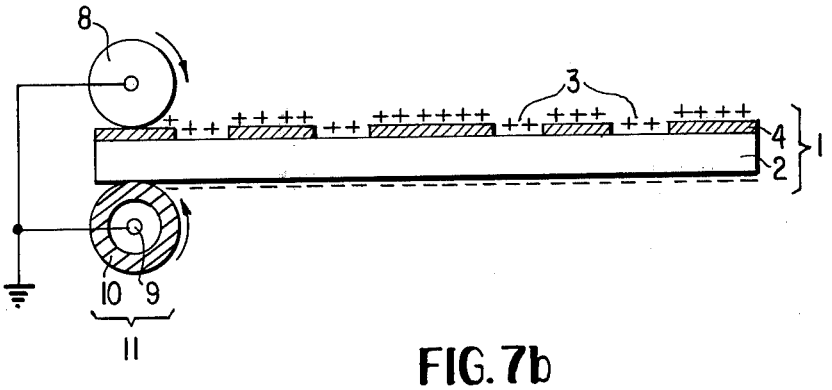
FIGS. 7*a* and 7*b* are explanatory views showing a modification of the grounding of the conductive layer portions according to the electrostatic image forming method of the present invention.

In FIG. 7*a*, one example is shown a method for grounding the conductive layer portions after they have been subjected to the charging treatment. This method is considered to be the most effective where the conductive layer formed on the surface of the insulating support has a substantial thickness (more than about 5 $\mu$).

Figure 6:
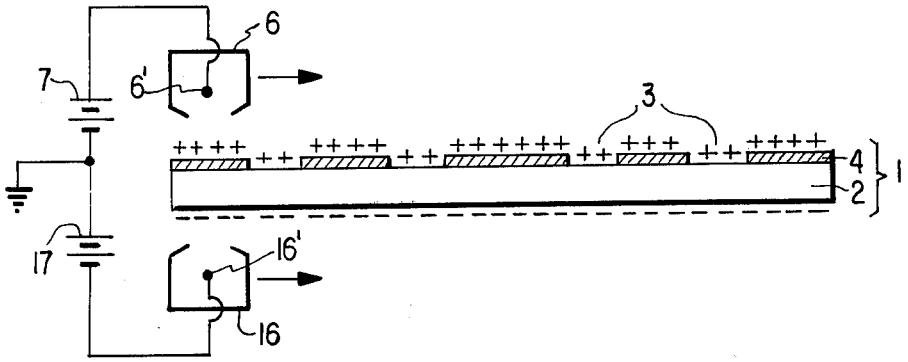
FIG. 6 is an explanatory view showing a modification of the charging step of the electrostatic image forming method of the present invention.

As shown in FIG. 7*a*, a pair of rollers 8 and 11, which are electrically connected with each other, are rolled on the material 1, in which the surface and back face are charged by the method as shown either in FIGS. 5*a* to 5*d* or in FIG. 6, in a manner such that the surface is in contact with the roller 8 whereas the back face is in contact with the roller 11.

The roller 8 is made of a conductive material such as of a metal, e.g., copper, aluminum, brass, stainless steel and duralumin, and has a relatively rigid surface. In this embodiment essentially any metal which is conductive and relatively hard can be employed. The roller 11 is, on the other hand, composed both of a bonductive and elastic outer portion 10 which is molded of a conductive rubber (which may preferably have a resistance of less than about $10^9\Omega$cm) such as a rubber produced by mixing a rubber material having a eleastic hardness of 10 to 100, such as, natural rubber, butyl rubber (Buna), neoprene, styrene-butadiene rubber (SBR), butyl rubber or silicone rubber with a conductive material such as carbon, e.g., graft carbon, or powders of metals such as aluminum copper, silver, gold, iron, etc., and of a metal roller 9 acting as a core.

These rollers 8 and 11 are contacted under a suitable pressure with the material 1 and rotated in the directions of the respective arrows. The desired level of the pressure to be applied is, for example, about 0.1 to 10 Kg/cm$^2$. The charges, which are temporarily stored in the conductive layer portions 4 of the material inserted between the paired rollers, are allowed to leak to the earth through the roller 8, and the charges in the back face of the insulating support 2 are also allowed, when the above opposite charges disappear, to leak to the earth through the roller 11. After the charges on the surfaces of the conductive layer portions 4 have been erased in the manner as described above, charges of a uniform level can be left both in the insulating image forming portions 3 for forming the desired electrostatic image and in those portions of the back face of the insulating support 2, which correspond to the insulating portions 3, as is better shown in FIG. 7*b*.

Each of the conductive layer portions normally has an area wider than 1 mm$^2$, even if it has an island shape such as is electrically isolated from the other. This makes it possible for the charges to leak from one of the conductive layer portions when the conductive roller is brought into contact with a part of that particular portion. Since, moreover, the conductive layer portions form the desired embossed pattern on an insulating support, the conductive roller hardly fails to contact with the portions to thereby allow the charges therein to leak to the earth, even if the roller has a rigid surface. On the contrary, the insulating image forming portions form the desired engraved patterns which are recessed from the conductive layer portions, so that they barely touch the roller 8 which is conductive but has a rigid surface. If, moreover, the image forming portions should partially contact the roller 8, only the charges in the limited area might leak, but leakage of the charges in a wider area including the contacting part would never occur, because the image forming portions are made of an insulating material.

As a result, the charges in those portions of the back face of the insulating support, which correspond to the conductive layer portions, are neutralized and disappear. On the contrary, since the charges still remain in the image forming portions, the corresponding counter charges also remain in the back face of the insulating support.

Figure 7B:
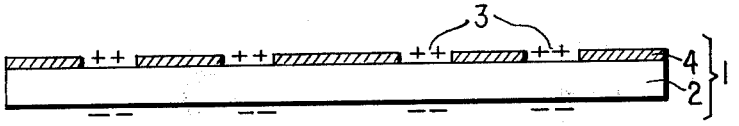

Thus, according to the grounding method under discussion, no charges remain in those areas of the back face of the support, which correspond to the conductive layer portions 4, as is understandable from FIG. 7*b*. This is considered important as a major advantage, in the case, for example, where the electrostatic image obtained is to be developed using toners, in that the developing treatment can be free from any deterioration due to charges remaining in the back face of the support. A suitable toner which can be used is particles of a resin containing carbon black dispersed therein an example of a suitable toner composition is polyvinylbutyral resin 25% by weight, rosin modified phenol formaldehyde resin 70% by weight and carbon black 5% by weight. Other toners or binder can be used. Generally, any toner which is used for conventional electrophotographic use can be used employed.

Suitable method in which toners are selectively adhered to the latent electrostatic image formed include dry developing methods such as a cascade developing method, a magnetic brush method, etc. If desired transfer of the toner image using conventional techniques to another substrate or support can be accomplished.

In the foregoing, although the descriptions of the present invention have been directed to embodiments in which the charges applied both to the conductive layer portions on the surface of the material 1 and to the electrostatic image have a positive polarity, it will be understandable that similar results can be obtained if the polarity of the charges is of negative nature.

The invention is explained in greater detail by reference to the following examples. Unless otherwise indicated all-parts, percent, ratios and the like are by weight.

EXAMPLE 1

A liquid having the following composition was applied, after the composition had been dispersed in a ball mill, to the surface of cellulose acetate film having a thickness of 100 $\mu$, and then was dried to form the desired conductive layer. The conductive layer thus obtained had a thickness of 10 $\mu$.

The composition of the liquid applied was:

| | weight parts |
|---|---|
| Carbon Black | 1 |
| Styrenated Alkyd Resin | 1 |
| Toluene | 5 |

The surface resistance of the obtained conductive layer was about 8 KΩ/□. The conductive layer was removed partially in a patternlike manner from the film obtained with the use of a stencil pen for scribe recording, so as to form a desired pattern as is shown in FIG. 1*b*. Thus, the electrostatic image forming material was produced. Then, the material was subjected to the corona charging operation in the manner as shown in FIG. 5*b*. As a result, charges having a potential of about + 700 V were uniformly caught both by the left conductive layer portions and by the insulating image forming portions. In this instance, the voltage impressed upon the corona charger was + 6 KV. Then, the conductive layer portions were made to contact the tip of a lead wire which was grounded to the earth. As a result, the charges in the conductive layer portions were neutralized to leave a uniform electrostatic image on the image forming portions.

EXAMPLE 2

An electrostatic image forming material produced in a similar manner to Example I was subjected to the double corona charging operation as shown in FIG. 6. This resulted in charges of about + 550 V being substantially uniformly stored temporarily both in the conductive layer portions and in the image forming portions. In this instance, the voltages impressed upon the two corona chargers were + 5 KV and − 5 KV, respectively.

Then, the tip of a grounded lead wire was brought into contact with the conductive layer portions. As a result, the charges in the conductive layer portions were neutralized to leave a uniform electrostatic image on the image forming portions.

EXAMPLE 3

The electrostatic image forming material was prepared by removing partially in a pattern-like manner using a scribe-recording stencil pen an aluminum layer which was vacuum-evaporated with a thickness of about 1 $\mu$ on a polyethylene terephthalate film having a thickness of 75 $\mu$. The material having such a composition was produced by Toray Industies, Inc. under the trade name of "Metalmy". This material was then subjected to a uniform charging operation and later to a grounding operation in a similar manner to that described in Example 1. As a result, a uniform electrostatic image was obtained on the image forming portions.

EXAMPLE 4

An electrostatic image forming material similar to that of Example 1 was subjected to a corona charging operation similar to that of Example 1. The material thus charged was then inserted between the paired rollers to form the desired electrostatic image.

A stainless steel roller having a diameter of 20 mm $\phi$ was employed as the roller to be brought into contact with the surface (including the conductive layer portions) of the material. As the roller to be brought into contact with the back face of the insulating support, on the other hand, a roller having an outer diameter of about 20 mm $\phi$ composed both of a core roller made of soft steel and having a diameter of 8 mm $\phi$ and of a conductive rubber having an outer diameter of about 20 mm $\phi$ and made of neoprene rubber of a hardness of about 50 impregnated with carbon was used. The applied pressure between these paired rollers was 1 Kg/cm$^2$.

As a result, a uniform electrostatic image was formed on the image forming portions, and those charges of the opposite polarity, which had been temporarily stored in such areas of the back face of the insulating support corresponding to the conductive layer portions, were removed.

EXAMPLE 5

An intermediate layer having the following composition was applied to the surface of a polyethylene terephthalate film having a thickness of 100 $\mu$, so as to form a dried intermediate layer having a thickness of 12 $\mu$. The intermediate layer thus obtained became a layer having a suitable brittleness, because a blushing phenomenon due to concentration of the moisture content accompanying the rapid evaporation of a solvent during the drying operation occurred.

The composition of the intermediate layer was:

| | weight parts |
|---|---|
| Barium Stearate | 80 |
| Nitrocellulose | 70 |
| Ethylcellulose | 30 |
| Acetone | 700 |
| Methyl Ethyl Ketone | 150 |
| Methanol | 200 |

The intermediate layer thus obtained had a resistance higher than $10^{15}\Omega/\square$ and could be said to have an insulating property. A liquid prepared similar to that described in Example 1 was then applied to the surface of the intermediate layer in a manner to have a dried thickness of about 3 $\mu$, thus producing the desired electrostatic image forming material. A desired pattern was then drawn on the conductive layer of this material using a stencil pen. As a result, both the conductive layer and the intermediate layer were partially removed to form engraved image forming portions on the exposed surface of the insulating support. The resultant material was then subjected to charging and grounding operations in a similar manner to those of Example 4. As a result, a satisfactory electrostatic image could be obtained on the image forming portions.

EXAMPLE 6

A substrate for a printed circuit was prepared, in which a copper plate having a thickness of 0.1 mm was adhered to a substrate having a thickness of 1 mm and made of a phenol resin. Then, the surfaces of the image non-forming portions of the copper plate were covered with an oil-soluble ink using a commercial felt pen. The print substrate thus treated was then dipped in an aqueous solution of 50% ferric chloride so as to subject the copper plate to an etching treatment. As a result, the surface of the phenol resin substrate was partially exposed in the form of a desired pattern. The surface resistivity of the phenol resin substrate was higher than $10^{15}\Omega$. After that, the oil-soluble ink remaining on the surface portions of the conductive copper plate was removed using methanol, thus producing the desired electrostatic image forming material.

The material thus prepared was then subjected to charging and grounding operations in a similar manner to those of Example 4. As a result, a uniform electrostatic image could be obtained on the image forming portions.

While the invention has been described in detail and with reference to specific embodiments thereof, it will be apparent to one skilled in the art that various changes and modifications can be made therein without departing from the spirit and scope thereof.

What is claimed is:

1. An electrostatic image forming method comprising:

uniformly charging with corona discharge a first surface of an electrostatic image forming member comprising an electrically insulating support having a surface resistance greater than about $10^{12}\Omega/cm^2$ and a conductive layer having a surface resistance less than about $10^{9}\Omega/cm^2$ disposed on said insulating support, said layer having open portions which form a pattern therein and expose the recessed surface of said insulating support member, said support member comprising the only support for said conductive layer where an optional insulative intermediate layer may be disposed between said conductive layer and said support member, the pattern formed in said conductive layer resulting in conductive layer portions completely surrounded by recessed surface portions of said insulating support, the uniform charging being such that all conductive layer portions are electrically isolated from the earth during the charging so that the surfaces of all said conductive layer portions and said recessed surface portions of said insulating support are uniformly charged; and subsequently grounding the surfaces of all of the charged conductive layer portions to the earth by connecting said last-mentioned portions to earth by an electrical conductor so as to remove the charges therefrom so that the charges in the said recessed surface portions of the insulating support remain as an electrostatic latent image.

2. The electrostaic image forming method according to claim 1, wherein the uniformly charging further includes simultaneously charging the face opposite said first face of said electrostatic image forming member in an opposite polarity.

3. The electrostatic image forming method according to claim 1, further comprising grounding the face opposite said first face of said electrostatic image forming member to the earth so as to remove counter-charges built up therein.

4. The electrostatic image forming method according to claim 3, including substantially simultaneously grounding sia charged conductive layer portions and the face opposite said first face of said electrostatic image forming member.

5. The electrostatic latent image forming method according to claim 1 where said conductive layer portions are at least 1 $mm^2$ in area.

6. A method as in claim 1 where said optional insulative intermediate layer has a surface resistance greater than $10^{15}\Omega/cm^2$.

7. The electrostatic image forming method according to claim 6, including selectively adhering toner particles to the recessed surface portions having an insulating surface.

8. The electrostatic image forming method according to claim 7, including transferring the selectively adhered toner particles to another support.

9. The electrostatic image forming method according to claim 1 where said conductive layer portions have a time constant CR with respect to said earth which is larger than about two seconds where C is the electrostatic capacity of said conductive layer portions with respect to said earth and R is the resistivity therebetween.

10. The electrostatic latent image forming method according to claim 9 where said time constant is larger than ten seconds.

* * * * *